US006695758B2

(12) United States Patent
Dostie

(10) Patent No.: US 6,695,758 B2
(45) Date of Patent: Feb. 24, 2004

(54) SHEET FOLDING DEVICE

(76) Inventor: Pierre Dostie, 1252 des Tourterelles, Ste Elie d'Orford (CA), J0B 2S0

( * ) Notice: Subject to any disclaimer, the term of this patent is extended or adjusted under 35 U.S.C. 154(b) by 0 days.

(21) Appl. No.: 10/148,476

(22) PCT Filed: Nov. 30, 2000

(86) PCT No.: PCT/CA00/01424

§ 371 (c)(1),
(2), (4) Date: Sep. 20, 2002

(87) PCT Pub. No.: WO01/39990

PCT Pub. Date: Jun. 7, 2001

(65) Prior Publication Data

US 2003/0078149 A1 Apr. 24, 2003

(30) Foreign Application Priority Data

Dec. 1, 1999 (CA) ..... 2290872

(51) Int. Cl.[7] ..... B31B 1/26; B31F 1/08
(52) U.S. Cl. ..... 493/405; 493/455
(58) Field of Search ..... 493/405, 455

(56) References Cited

U.S. PATENT DOCUMENTS 797,864 A * 8/1905 Naylor ..... 493/405
3,092,379 A * 6/1963 Collier ..... 493/405
4,421,500 A * 12/1983 Smith ..... 493/405
5,259,827 A * 11/1993 Staniszewski et al. ..... 493/451
5,348,526 A * 9/1994 Feygin ..... 493/405
5,378,222 A * 1/1995 Weber ..... 493/405
5,380,265 A * 1/1995 Giovinazzo et al. ..... 493/405
5,842,963 A * 12/1998 Meesters ..... 493/405
5,944,647 A * 8/1999 Reynolds ..... 493/405

FOREIGN PATENT DOCUMENTS

| | | |
|---|---|---|
| DE | 30 41 618 | 6/1982 |
| FR | 2 460 213 | 1/1981 |
| FR | 2 639 927 | 6/1990 |

* cited by examiner

*Primary Examiner*—Rinaldi I. Rada
*Assistant Examiner*—Hemant M. Desai
(74) *Attorney, Agent, or Firm*—Collard and Roe, P.C.

(57) ABSTRACT

The invention concerns an office accessory or sheet folding device, designed and adapted to facilitate accurate folding of paper sheets of standard height and width for insertion into commercial envelopes with corresponding dimensions. The sheet folding device which can be made in plastic, comprises a planar base having a width substantially equal to the width of the sheet to be folded. Limit stops extend at the lower edge of the base. The limit stops project slightly above the base to serve as support to the lower edge of the sheets to be folded. At least two folding guides extend transversely over the entire width of the base at specific heights from the lower edge thereof. The guides form steps or bumps triangular in shape and enabling a user who has positioned one or several sheets of paper to be folded on the base and supported on the limit stops, to press with his/her fingers on the sheet(s) along the guides to define and pre-form the folding lines so as to be subsequently able to fold the sheet(s) into at least three parts for their insertion in commercial envelopes. The letter folding device has a very simple structure, is economical and very easy to use.

11 Claims, 10 Drawing Sheets

LEGAL
8.5" x 14"

FACTURE
VERTICALE
8.5" x 11"

LETTRE
8.5" x 11"

FACTURE
HORIZONTALE
11" x 8.5"

SHEET FOLDING DEVICE

CROSS REFERENCE TO RELATED APPLICATIONS

Applicant claims priority under 35 U.S.C. §119 of Canadian Application No. 2,290,872 filed Dec. 1, 1999. Applicant also claims priority under 35 U.S.C. §365 of PCT/CA00/01424 filed Nov. 30, 2000. The international application under PCT article 21(2) was not published in English.

FIELD OF THE INVENTION

The present invention relates to an office accessory hereafter called <<sheet folding device>>, which is designed and adapted to facilitate accurate folding of sheets of paper of standard height and width for insertion into commercial envelopes of corresponding dimensions.

BRIEF DESCRIPTION OF THE PROBLEM TO BE SOLVED

It is known that many standardized formats exist for sheets of paper:

letter format (8.5 inches×11 inches)

legal format (8.5. inches×14 inches)

"horizontal bill" format (11 inches×8.5 inches)

A4 format (21 cm×29.7 cm).

The first three formats listed here above are those commonly used in North America. The fourth one is mainly used in Europe.

There also exists standardized envelope formats to receive these sheets after they have been folded in two (administrative format), three (letter format) or four along the same direction (legal format) or in four along both directions (horizontal bill format). These envelopes (10" commercial format) may be provided with a window.

Folding of the sheets in order to insert them into the envelopes is compulsory in all cases and requests a certain dexterity. Indeed, if the folding lines are irregularly spaced out, the sheets may not enter into the envelopes or the address printed on them may not be centred in the window provided for this purpose.

There presently are mechanical office equipments for use to fold sheets of letter format only, and to insert them into envelopes. These equipments are efficient but costly and are therefore profitable only when the volume of sheets to be folded and be inserted into envelopes is large.

To the Applicant's knowledge, there is no simple and inexpensive equipment that may be used as an office accessory to facilitate the work of any person having to fold sheets on a regular basis.

SUMMARY OF THE INVENTION

The object of the present invention is to provide a sheet folding device of extremely simple structure and easy manipulation which answers the need evoked herein above.

More precisely, the object of the invention is a sheet folding device that is designed and adapted to facilitate exact and rapid folding of sheets of paper of standard height and width in order to insert them into commercial envelopes of corresponding dimensions.

The sheet folding device according to the invention is characterized in that it comprises:

a planar base made of rigid material, said base having a width substantially equal to the standard width of the sheets to be folded and a height at least equal to two thirds of the standard height of said sheets, and presenting a lower edge and two lateral edges;

at least one limit stop is integral to the base, said at least one limit stop extending at the level of the lower edge of the base and projecting slightly above said lower edge in order to serve as a support to the lower edges of the sheets to be folded; and folding guides integral to the base, said guides shaped and placed in such a way as to permits to pre-form folding lines in order to subsequently fold the sheet(s) and insert them into commercial envelopes.

This sheet-folding device is characterized in that:

the folding guides are at least three in number, the first one of the guides extending transversely along the entire width of the base at a distance from the lower edge substantially equal to a third of the standard height of said sheets, the second one of said guides extending transversely along the entire width of the base at a distance from the lower edge substantially equal to two thirds of the standard height of said sheets, the third one of said guides extending transversely along the entire width of the base at a distance from the lower edge substantially corresponding to half of the standard height of said sheets to be folded; and said folding guides have a triangular cross-section to allow a user having positioned one or more sheets of paper to be folded on the base and resting on the limit stop(s), to press with his/her fingers upon the sheet(s) along the guides in order to define and manually pre-form said required folding lines for folding purpose.

It will be understood that the first and second guides allow the folding of sheets into three parts. The third guide allows the folding of sheets in two parts according to the administrative format.

Two other guides may also be provided for the sheet folding device destined to be used with legal format sheets or horizontal bills.

As it may be appreciated, the sheet folding device according to the invention is of very simple structure. It is economical and easy to use. It does not include any moveable elements and does not need to be connected to an energy source. It is small in size and easy to store. It may be easily sold and used as an office accessory in order to facilitate secretarial work.

The invention and its advantages will be better understood upon reading the following detailed description of several preferred embodiments thereof, made with reference to the accompanying drawings.

BRIEF DESCRIPTION OF THE DRAWINGS

In the accompanying drawings, the same reference numerals have been used to identify the same elements of to the two illustrated embodiments.

DETAILED DESCRIPTION OF TWO PREFERRED EMBODIMENTS OF THE INVENTION

Figure 1:
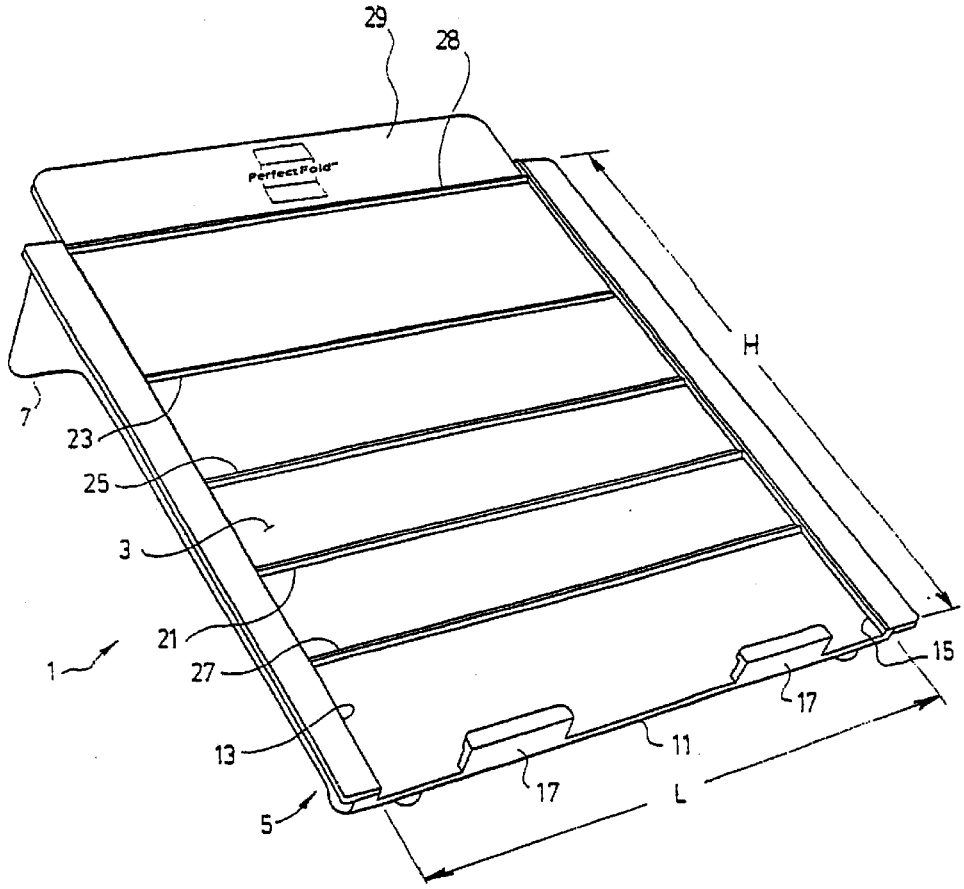
FIG. 1 is a perspective view of a sheet folding device according to a first preferred embodiment of the invention which is specifically adapted for folding sheets used in North America, namely those of letter format, legal format and "horizontal bill" format.
Figure 4:
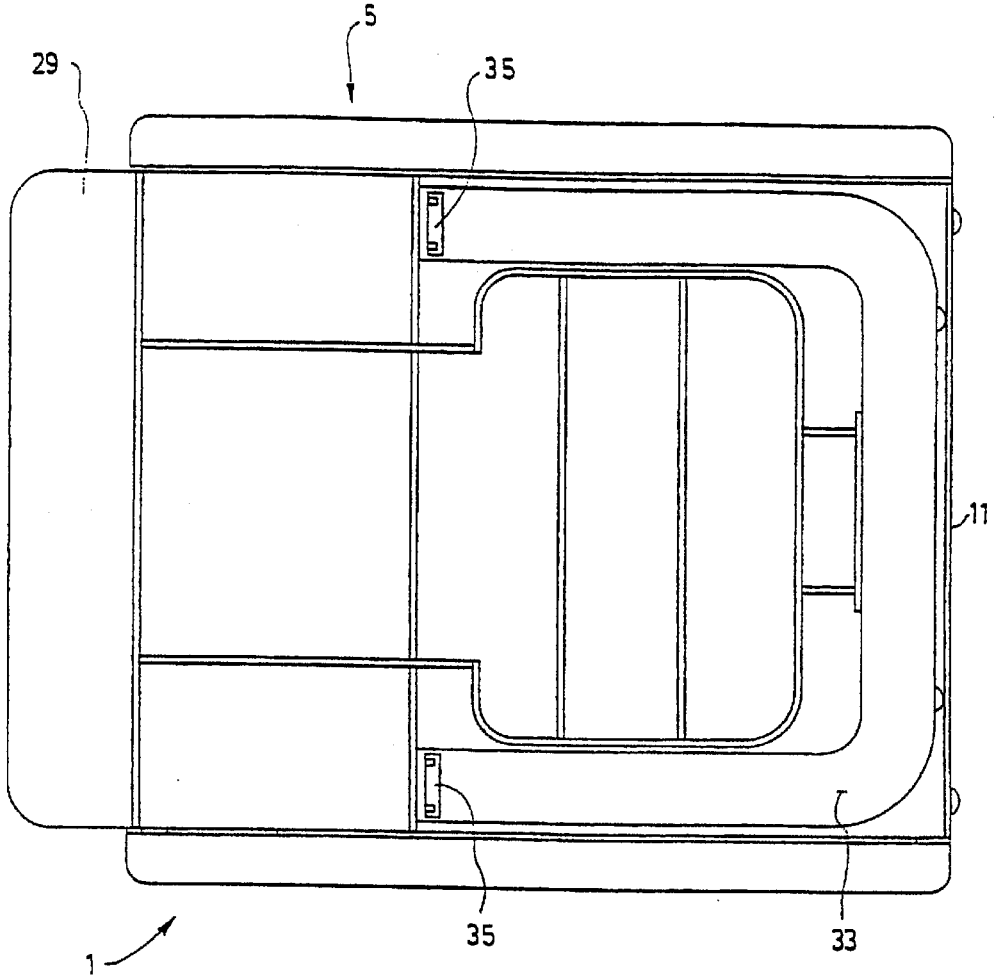
FIGS. 2, 3 and 4 are side, from bottom and top views of the sheet folding device shown in FIG. 1, respectively.

The "sheet folding device" 1 according to each of the two preferred embodiments of the invention illustrated in the drawings is designed and adapted to facilitate accurate and rapid folding of sheets of paper of standard height and width for insertion in commercial envelopes of corresponding dimensions.

Figure 2:
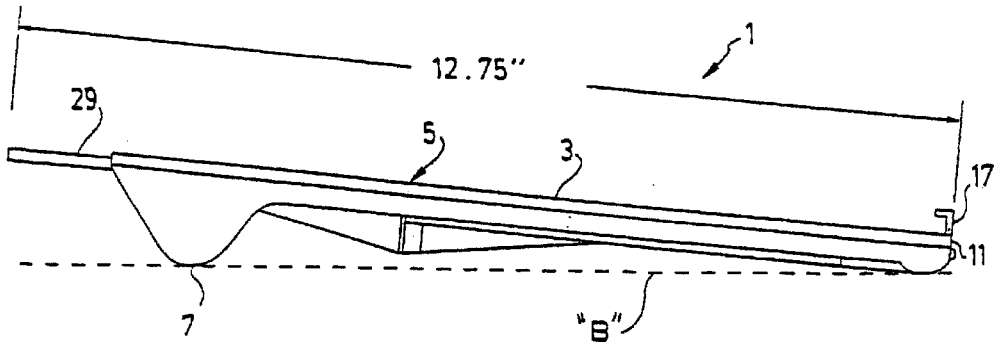
Figure 8:
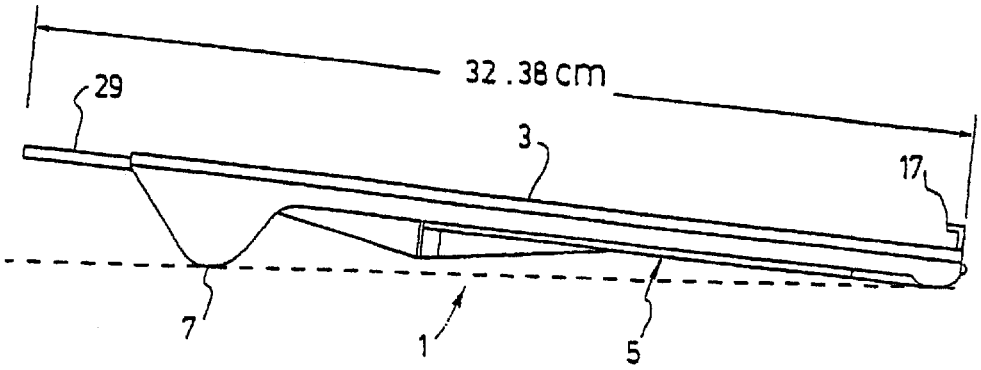

It comprises a planar base 3 formed on the upper surface of a piece 5 made of rigid material, such as a moulded plastic material. Preferably, this piece 5 has short legs 7 under its lower surface so that when it is positioned flat on a horizontal surface such as a desk "B" (illustrated in dotted lines in FIGS. 2 and 8), the base 3 extends at an angle and makes the folding more ergonomical.

The base 3 has a width substantially equal to the standard width "L" of the sheets to be folded and a standard height "H" equal to at least two thirds of the height of the sheets to be folded (this standard height is 11 inches in the case of letter-format sheets and 29.4 cm in the case of A4 format sheets) However, in the illustrated embodiment, the height H is equal to or slightly superior to said standard height in order to make the sheet folding device easier to use. The base has a lower edge 11 and two lateral edges 13,15 and is preferably shaped in order to have a non-skid surface.

At least one and preferably two limit stops 17 extends at the level of the lower edge 11 of the base 3. These limit stops 7 are integral parts of the base and project slightly over its lower edge 11 in order to serve as a support to the lower edges of the sheets to be folded.

Several folding guides extend transversely along the entire width of the base.

The first one of these guides, numbered 21, extends substantially to one third of the standard height of the sheets to be folded, from the lower edge 11 (approximately 3.7 inches in the case of letter format sheets and 9.9 cm in the case of A4 format sheets).

The second one of these guides, numbered 23, extends substantially at two thirds of the standard height of the sheets to be folded, from the lower edge 11 (approximately 7.4 inches in the case of letter format sheets and 19.8 cm in the case of A4 format sheets).

Preferably, in order to give more possibilities of use to the sheet folding device 1, a third guide 25 may extend transversely along the entire width of the base, at a distance from the lower edge 11 corresponding substantially one half of the standard height of the sheets to be folded (approximately 5.4 inches in the case of letter format sheets and 14.85 cm in the case of A4 format sheets).

In the case of the sheet folding device intended to be used to fold letter format sheets (see FIGS. 1 to 6), two other guides 27, 28 may be provided to fold the two other types of North American format sheets, namely legal format sheets and "horizontal bills". A fourth guide 27 may therefore be used which extend transversely along the entire width of the base at a distance from the lower edge 11 approximately equal to 2.1 inches. The fifth guide 28 extends transversely along the entire width of the base at a distance from the lower edge equal to that of the letter format sheets, namely 11 inches.

All these guides 21, 23, 25, 27 and 28 are integral to the base and consist of steps or bumps of triangular shape. They allow a user having positioned one or several sheets of paper to be folded on the base against the limit stops 17, to press with his/her fingers on the sheets along the guides in order to define and pre-form folding lines in order to subsequently allow the sheets to be folded in at least three parts for insertion in the commercial envelopes.

It will be noted that the lateral edges 13 and 15 of the base preferably have the shape of a step as is illustrated in the drawings to provide the user with one or two lateral guides. These lateral guides project over the base and facilitate the positioning of sheets of paper.

Figure 9:
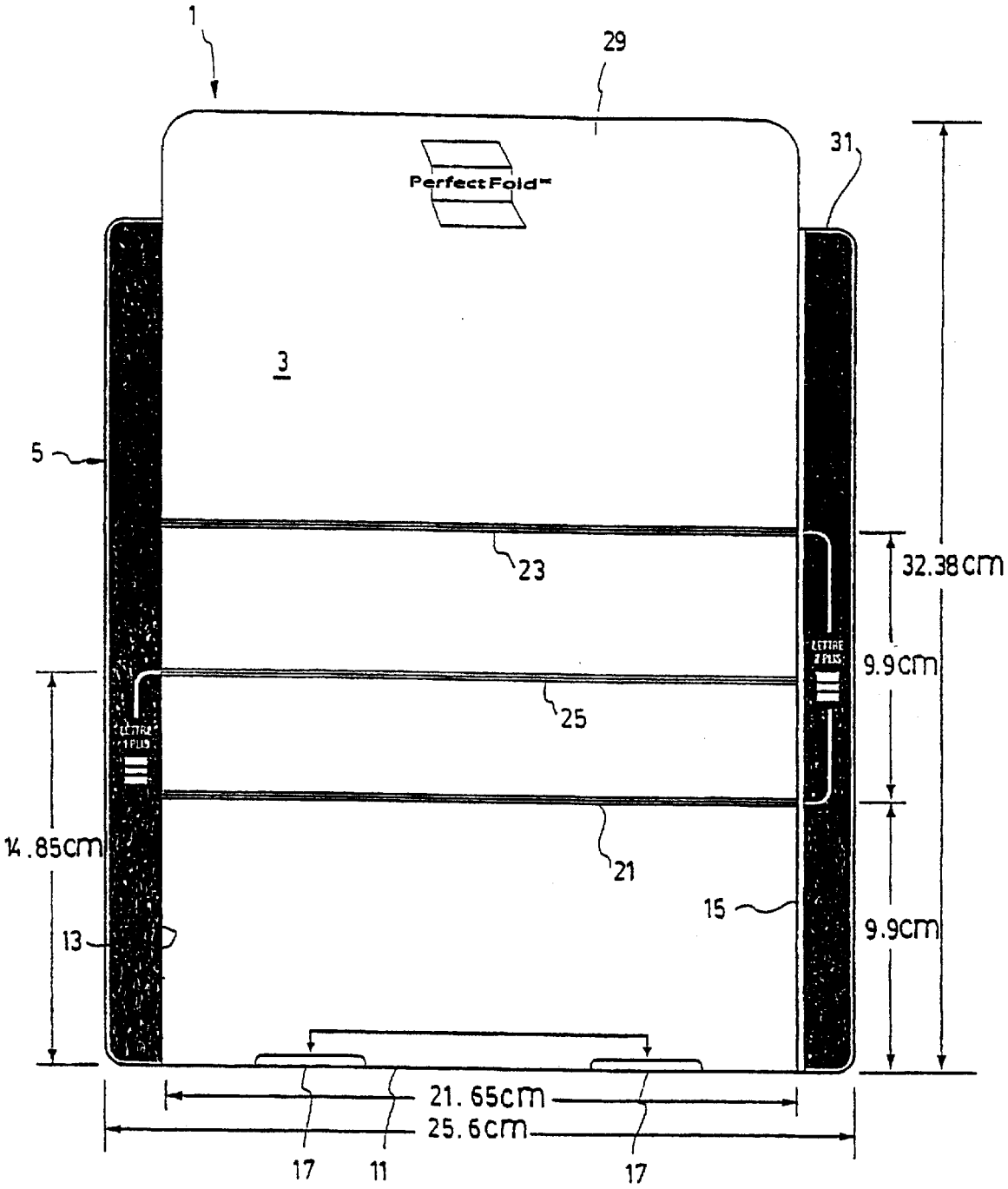

The piece 5, the upper surface of which forms the base 3, may advantageously be provided with an extension 29 which extends over the folding template mentioned above. This extension 29 is preferably dimensioned to act as a support to the balance of the sheets to be folded when then sheets are positioned onto the base. Preferably also, folding markers 31 (see FIGS. 3 and 9) may be stuck to the sides of piece 3 to identify the guides mentioned on the marker 31 and specify when they must be used. Such makes the sheet folding device 1 even more simple to use.

Figure 5:
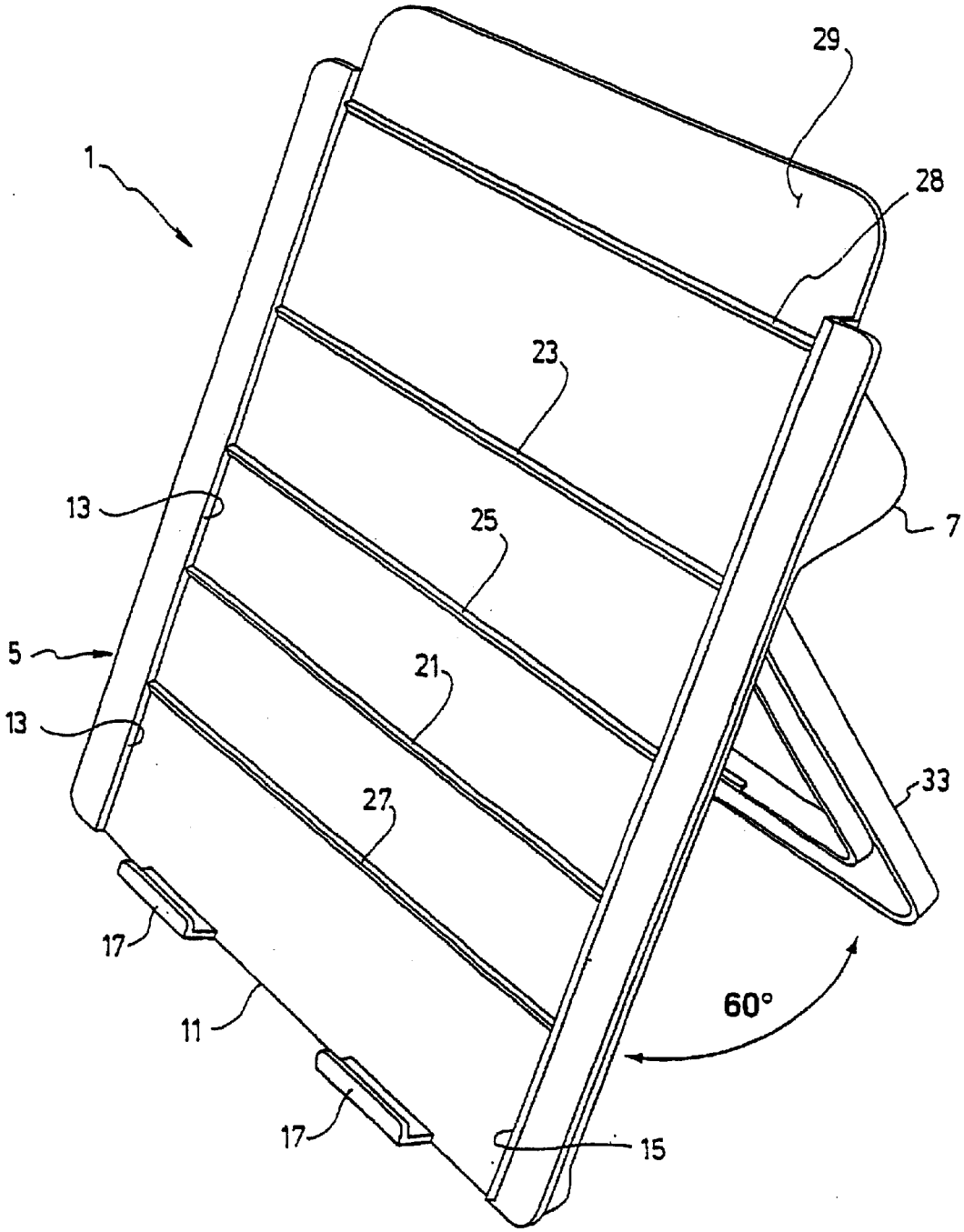
FIG. 5 is a perspective view of the sheet folding device shown in FIGS. 1 to 4, with its rear support in an unfolded position in order to convert it into a copy-holder.
Figure 11:
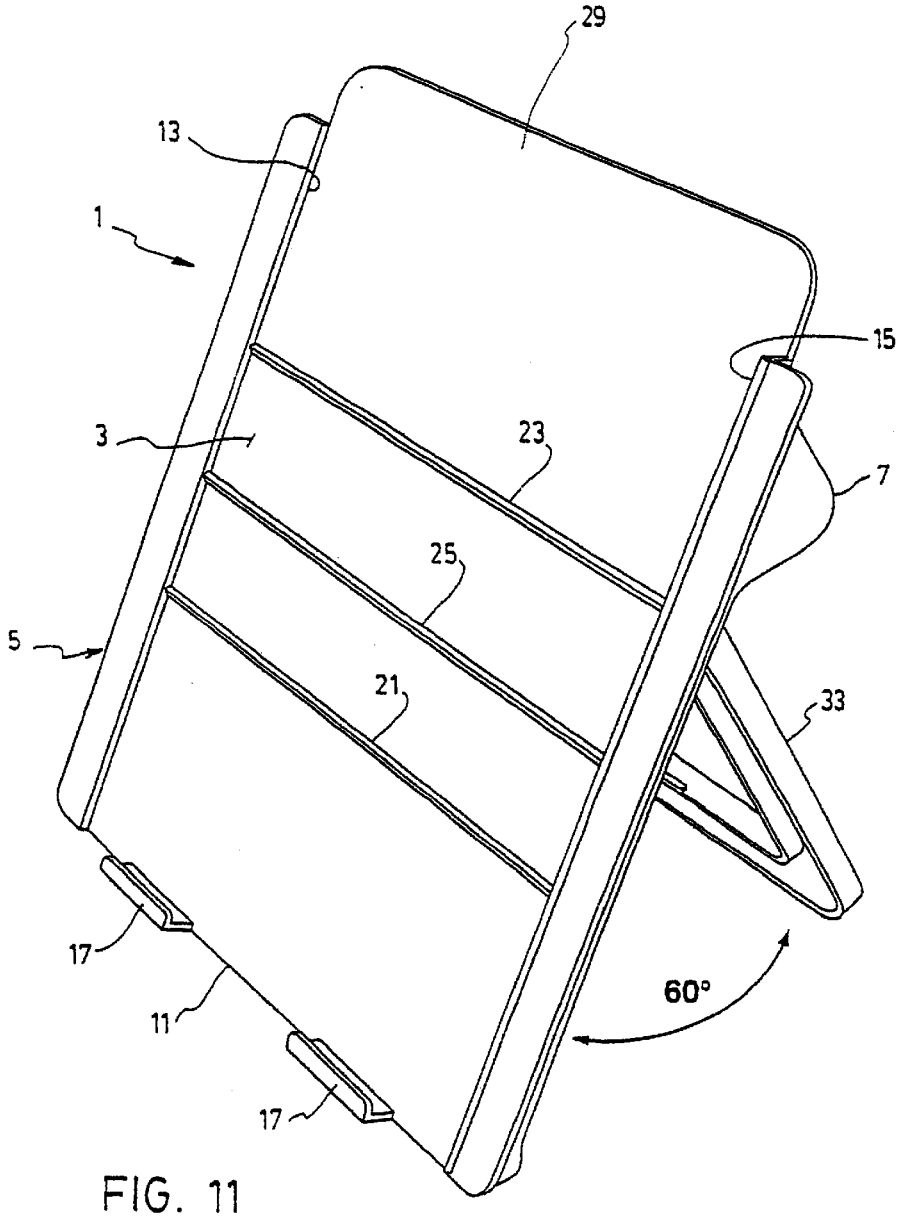
FIG. 11 is a perspective view of the sheet folding device shown in FIGS. 7 to 10, with its rear support in an unfolded position in order to convert it into a copy-holder.

The sheet folding device 1 may, whatever be the embodiment, be also provided with a unfolding rear support 33, mounted on aligned pivots 35 positioned under the piece 3 (see FIGS. 4, 5, 10 and 11). Once unfolded at its maximum angle which may be, for example of 60°, the support 33 allows the positioning of the piece 3 in inclined vertical position as is illustrated in FIGS. 5 and 11 and thereby makes the sheet folding device usable as a copyholder.

As it may be understood, the width "L" and height "H" of the base 3 of the sheet folding device 1 of the invention are selected as a function to the dimension of the sheets that the sheet folding device is intruded to fold.

Figure 3:
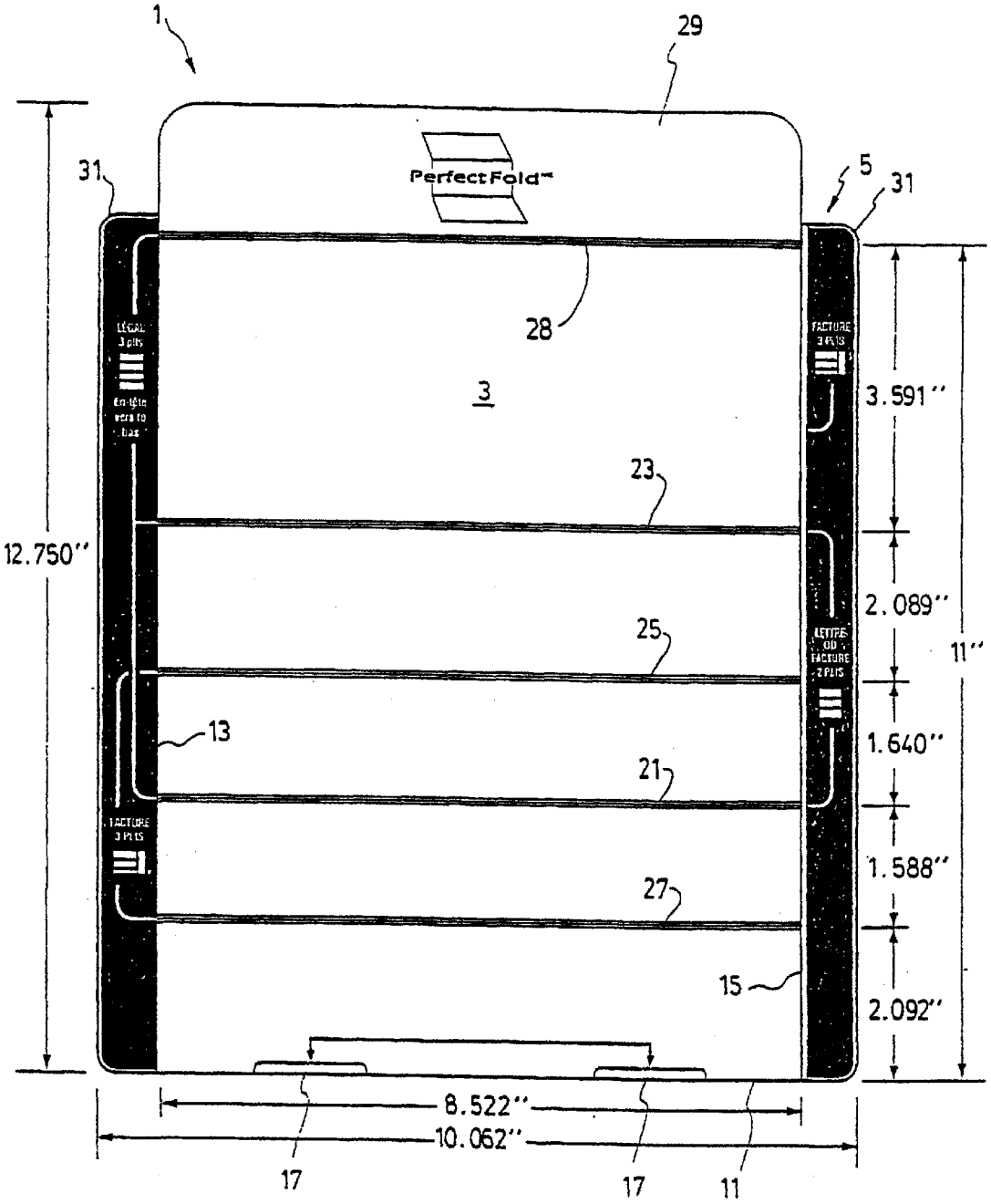

Thus, in the case of a sheet folding device for letter-format sheets, the base will have a width "L" of approximaty 8.5 inches and a height "H" preferably equal to the height of the sheets, viz. approximately 11 inches (see FIGS. 1 to 5 and more precisely FIG. 3 where specific dimensions are given). The sheets will be folded in three with the help of guides 21 and 23 (see FIG. 6*a*), or in two with the help of the guide 25.

The same sheet folding device, viz. a sheet folding device with the same dimensions as before (those of FIGS. 1 to 5), may also be used with legal format sheets. In the latter case, the sheets will be folded in four with the help of the guides 21, 23 and 28 (see FIG. 6*b*).

The same sheet folding device, viz. the one of FIGS. 1 to 5, may finally be used with "horizontal bill" format sheets. In the latter case, the folding will be carried out by placing the bill transversely on the base and resting it against one of its edges (for example, the edge numbered 13), by using one of the lateral guides described previously as a lateral bar stop. The guides 25 and 27 will then be used to form "vertical" folding lines on the sheet. Opposite edge 15 of the base will be used to fold the upper extremity of the sheet (see FIG. 6*c*).

Figure 12A:
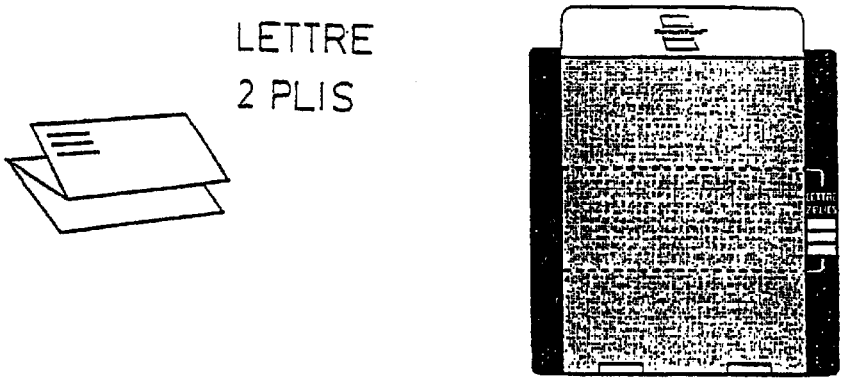
FIGS. 12*a* and 12*b* are illustrations of the way in which the sheet folding device illustrated in FIGS. 7 to 11 may be used with double-fold or single-fold A4 format sheets.

In the case of A4 format sheets (see FIGS. 7 to 11 and more precisely FIG. 9 where the dimensions are given), the sheet folding device will have a width "L" of approximating 21.65 cm and a height "H" of approximately 28 cm. Here again, the sheets will be folded in three with the help of the guides 21 and 23 (see FIG. 12*a*), or in two with the help of the guide 25 (see FIG. 12*b*).

In practice, the sheet folding device 1 according to the invention may be made of moulded plastic material as previously indicated, or of any other rigid material which may be easily shaped (aluminium, wood, etc . . . ). Also, as previously indicated, its base 3 is part of a piece 5 preferably provided with legs 7 in such a manner that the planar base is slightly inclined when it is positioned flat on a desk. In practice, this inclination may vary between 1 and 5 cm. The surface of the base is preferably designed to be a non-skidding surface. The guides 21, 23, 25, 27 and 28 may be dimensioned in order to allow simultaneous folding of several sheets (5 or even more). The sheet folding device 1 may not only be used for sheets of paper, but also for thin sheets of cardboard.

In practise, the sheet folding device according to the invention may be used as follows.

For letter format sheets (8.5 inches×11 inches) or A4 format sheets, one must place the sheet flat, in a vertical orientation and with the letter-head preferably at the top, on the surface of the base. Then, one must apply thumbs at the centre of the sheet along the central folding guide 21 and the index on upper folding guide 23, and, from the centre of the sheet, laterally glide the thumb and the index simultaneously while maintaining a certain pressure. This pressure, by contact, will create markings. Ultimately, it is sufficient to re-fold the sheet entirely according to the precise markings obtained, and to insert it into the envelope (see FIGS. 6*a* and 12*a*).

Figure 12B:
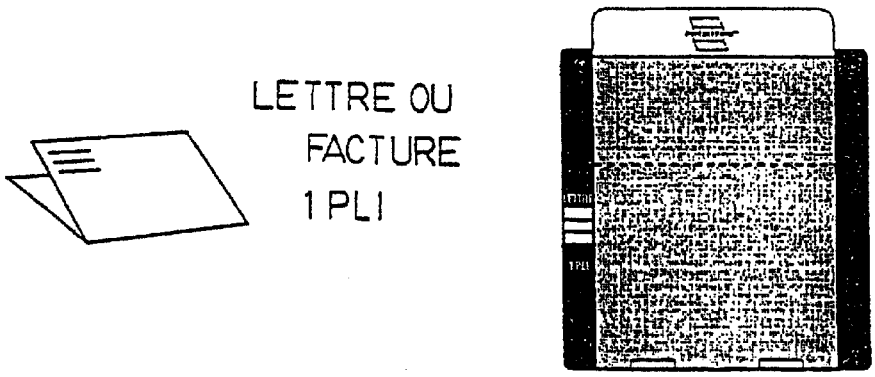

In A4 format, if folding the sheets in two is only desired, it is sufficient to apply a pressure on the guide 25 (see FIG. 12*b*).

Figure 6B:
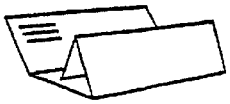
FIGS. 6*a* to 6*c* are illustrations of the way in which the sheet folding device illustrated in FIGS. 1 to 5 may be used with letter format sheets (or vertical bills), legal format sheets and horizontal bills.
Figure 6B:
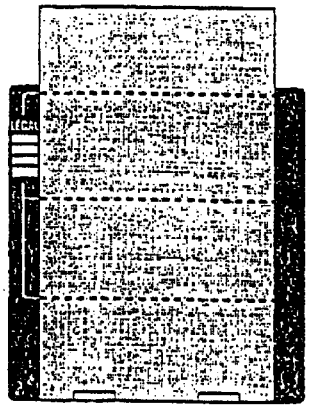
Figure 6A:
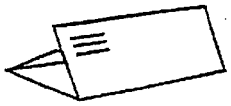
Figure 6A:
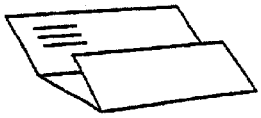
Figure 6A:
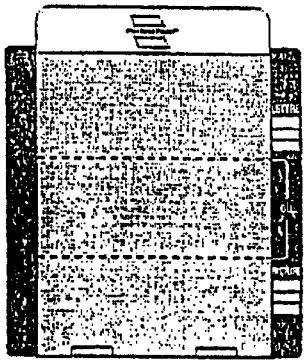
Figure 6C:
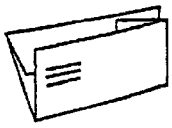
Figure 6C:
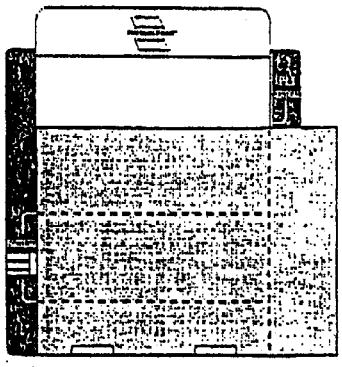
Figure 7:
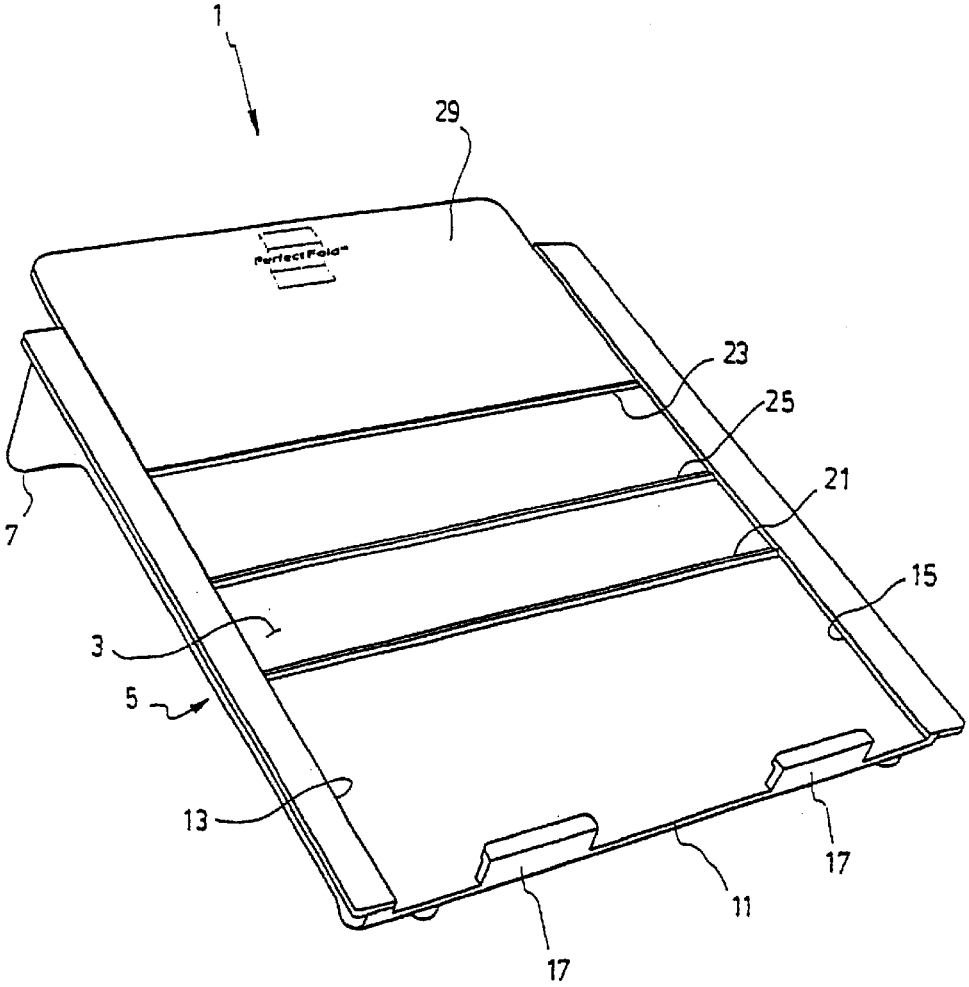
FIG. 7 is a perspective view of a sheet folding device according to a second preferred embodiment of the invention which is specifically adapted for folding sheets used in Europe, namely those of A4 format.
Figure 10:
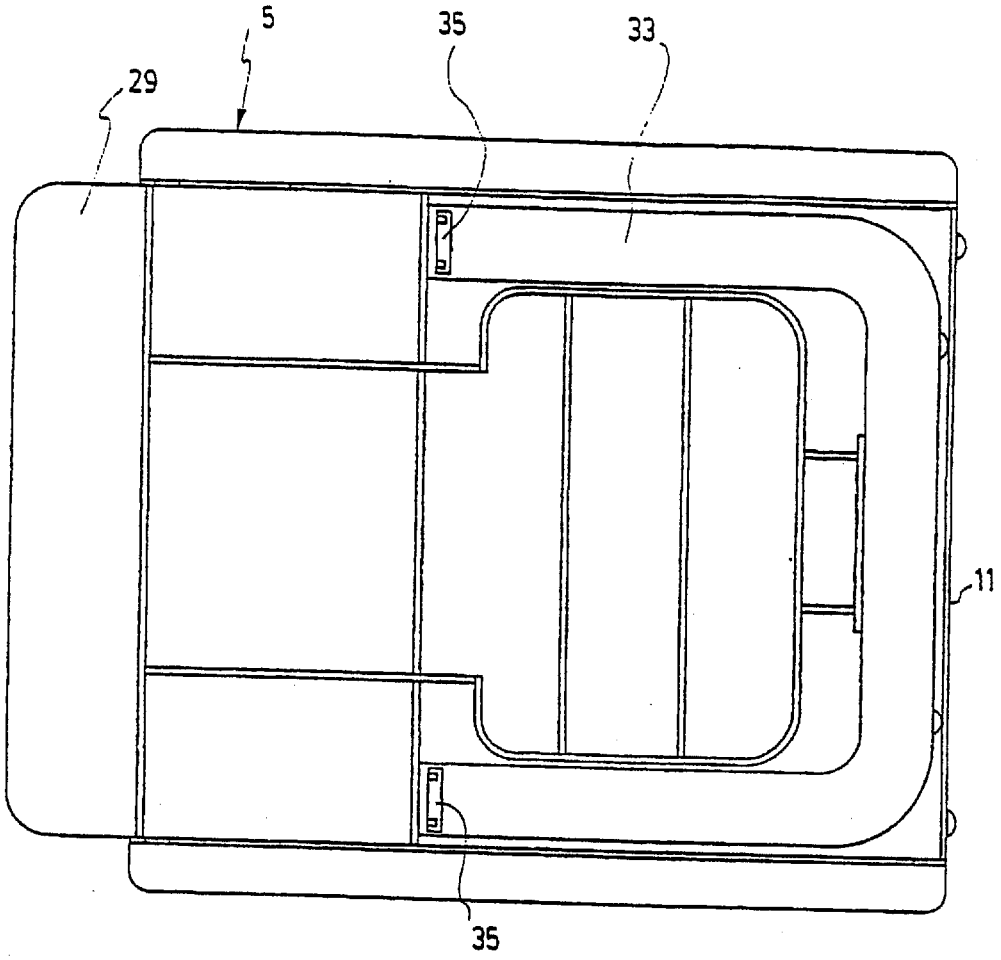
FIGS. 8, 9 and 10 are side, top and bottom views of the sheet folding device shown in FIG. 7, respectively.

For legal-format sheets (8.5 inches×14 inches), it is suitable to carry out the first step described here above while preferably placing the letter-head at the bottom (see FIG. 6*b*). Once this is completed, pressure with the thumbs may be re-applied along the guide 28.

For horizontal format sheets (11 inches×8.5 inches), it is suitable to place the sheet flat, in a horizontal orientation, and to execute the same thumb-index gesture as that for the other formats, but this time using the two other folding guides 25 and 27 located on either side of the central guide 21. Once the horizontal markings are made, it is sufficient to bring down the thumb along the axis of its lateral guide 15 in order to make the markings in a vertical orientation. Finally, one has only to fold the sheets along the markings before inserting them into the envelope (see FIG. 6*c*).

It goes without saying that many modifications could be made to the various embodiments described here above without departing from the scope of the invention.

What is claim is:

1. An office accessory hereafter called "sheet folding device" (1), which is designed and adapted to facilitate accurate and rapid folding of sheets of paper of standard height and length in order to insert them into commercial envelopes of corresponding dimensions, said sheet folding device comprising:

a planar base (3) made from a rigid material, said base having a width (L) substantially equal to the standard width of the sheets to be folded and a height (H) at least equal to two thirds of the standard height of said sheets, and having a lower edge (11) and two lateral edges (13,15);

at least one limit stop (17) integral to the base, said at least one limit stop(s) extending from the level of the lower edge (11) of the base and projecting slightly over this lower edge in order to serve as a support to the lower edges of the sheets to be folded; and folding guides (21, 23) integral to the base (3) , said folding guides being shaped and placed in such a way as to permit to preform folding lines in order to subsequently fold said sheets in two parts or more for inserting them into commercial envelopes, characterized in that:

said folding guides are at least three in number, the first one (21) of said guides extending transversely along the entire width of the base (3) at a distance from the lower edge substantially equal to one third of the standard height of said sheets, the second one (23) of said guides extending transversely along the entire width of the base at a distance from the lower edge substantially equal to two thirds of the standard height of said sheets, the third one of said guides (25) extending transversely along the entire width of the base at a distance from the lower edge corresponding substantially to half of the standard height of the sheets to be folded; and said folding guides (21,23,25) have a triangular cross-section to allow a user having positioned one or several sheets of paper to be folded on the base (3) and against the limit stop(s) (17), to press with his/her fingers on the sheet(s) along the guides in order to define and manually preform said required folding lines for folding purpose.

2. The sheet folding device according to claim 1, characterized in that the planar base (3) forms an integral part of a piece provided with legs (7) that ensures that when the base is placed on a horizontal surface (B), said base (3) extends at an angle relative to said surface in order to make the folding more ergonomical.

3. The sheet folding device according to claim 1, characterized in that it further comprises at least one lateral guide (13,15) integral to the base (3), each guide extending along one of the lateral edges of the base along the entire height of said base and having the shape of a step that projects slightly over said lateral edge to offer a support to the sheets.

4. The sheet folding device according to claim 3, characterized in that it comprises such a lateral guide (13,15) along each of its two lateral edges.

5. The sheet folding device according to claim 1, characterized in that it comprises an unfolding rear support (33) mounted on a pivot (35) under the base (3) in such a manner as to allow the positioning of said sheet folding device in an inclined vertical position.

6. The sheet folding device according to claim 1, characterized in that it is made of moulded plastic material.

7. The sheet folding device according to claim 1, characterized in that the base (3) has an upper anti-skid surface.

8. The sheet folding device according to claim 1, characterized in that it presents folding markers (31) along the edges (13,15) of the base in order to facilitate the identification of the folding guides (21,23,25).

9. The sheet folding device according to claim 1, (characterized in that it is adapted to the folding of letter format sheets and has it base with a width (L) of approximately 8.5 inches and a height (H) of approximately 11 inches.

10. The sheet folding device according to claim 9, characterized in that it further presents a fourth folding guide (27) extending transversely along the entire width equal to approximately 11 inches from the lower edge in order to facilitate the folding of legal format sheets, and a fifth guide (28) at approximately 2.1 inches from the lower edge in order to facilitate the folding of horizontal bill format sheets.

11. The sheet folding device according to claim 1, characterized in that it is adapted to the folding of A4 format sheets and has its base with a width (L) of approximately 21 cm and a base height (H) of approximately 28 cm.

* * * * *